United States Patent [19]

Kotera

[11] Patent Number: 4,617,814

[45] Date of Patent: Oct. 21, 1986

[54] PROCESS FOR CONTROLLING LOAD DISTRIBUTION IN CONTINUOUS ROLLING MILL

[75] Inventor: Yoshikazu Kotera, Hyogo, Japan

[73] Assignee: Mitsubishi Denki Kabushiki Kaisha, Tokyo, Japan

[21] Appl. No.: 734,113

[22] Filed: May 15, 1985

[30] Foreign Application Priority Data

May 16, 1984 [JP] Japan ..... 59-99852

[51] Int. Cl.[4] ..... B21B 37/12

[52] U.S. Cl. ..... 72/8; 72/19; 72/21

[58] Field of Search ..... 72/8, 19, 21

[56] References Cited

U.S. PATENT DOCUMENTS 4,485,497 12/1984 Miura ..... 72/8

*Primary Examiner*—Francis S. Husar
*Assistant Examiner*—Jorji M. Griffin
*Attorney, Agent, or Firm*—Bernard, Rothwell & Brown

[57] ABSTRACT

A process for controlling a ratio of load distribution among a plurality of rolling stands to roll a work progressively comprises storing, when a ratio of load distribution between a stand located at the most downstream position with respect to a travelling direction of a work and one or more selected stands located on the upstream side is different from a desired preset value therefor, an error and rolling conditions of the individual stands at that time, and storing controlling amounts of the control which was performed to correct the error as coefficient values and then using the coefficient values for determination of controlling amounts upon correcting control in the same conditions thereafter.

4 Claims, 2 Drawing Figures

PROCESS FOR CONTROLLING LOAD DISTRIBUTION IN CONTINUOUS ROLLING MILL

BACKGROUND OF THE INVENTION

1. Field of the Invention

This invention relates to a process for controlling load distribution to make a distribution ratio of rolling loads between different stands coincide with a preset value in a continuous rolling mill.

2. Description of the Prior Art

In a continuous rolling mill, it is strongly required that rolling loads to different stands stay between upper and lower limits provided for according to ratings of machines or appliances, and additionally, that the rolling load distribution ratio among the stands be coincident with a separately determined appropriate preset value.

FIG. 2 illustrates a conventional load distribution control of this type which is proposed, for example, by a Japanese Patent Application No. 58-192738. The arrangement includes a plurality of rolling stands #4, #5 and #6 which in turn include roll pairs 2*a*–3*a*, 2*b*–3*b* and 2*c*–3*c* for rolling a work 1 to be rolled, rolling reduction position controlling devices 4*a*, 4*b* and 4*c* and rolling load detecting devices 5*a*, 5*b* and 5*c*. Thus, rolling loads at the individual stands are detected by the load detecting devices 5*a*, 5*b* and 5*c* are compared with a set value of load distribution ratio in a load distribution controlling device 7 in order to change material thickness rolling reduction values for the individual stands in accordance with the results of such comparison, and at the same time, rolling reduction position correcting amounts ΔS4, ΔS5 and ΔS6 for the individual stands are calculated on condition that, as for a material thickness on the exit side of the last stand, a value before load distribution correcting control is maintained. Then, in accordance with the results of such calculations, instructions for changing are outputted to the rolling reduction position controlling devices 4*a*, 4*b* and 4*c* of the stands at such timings that a rolling reduction position changing point on the plate material by an upstream side stand reaches a downstream side stand.

Operations will be described now. It is assumed that stand rolling loads from the load detecting devices 5*a*, 5*b* and 5*c* are P4, P5 and P6. If set ratio values for them are C4, C5 and C6, then $$P4:P5:P6=C4:C5:C6 \tag{1}$$

For this equation, an error between the two downstream side stands #5 and #6 is estimated $$\Delta err5=C5\cdot P6-C6\cdot P \tag{2}$$

In order to make a load distribution ratio between the two stands coincide with C5:C6, the material thickness at the #5 stand is changed by $\Delta h5^L$ to vary P5 and P6 as follows:

$$\Delta P5=-Q5\cdot\Delta h5^L \tag{3}$$

$$\Delta P6=Q6\cdot\Delta h5^L \quad 4)$$

Here, $$\Delta h5^L=-\frac{\Delta err5}{\Delta 5} \tag{5}$$

$$\Delta 5=C5\cdot Q6+C6\cdot Q \tag{6}$$

Here, Q5 and Q6 are influence coefficients which is had on the rolling loads P5 and P6 by a change Δh5 of the material thickness, and substantially accurate values can be obtained therefor by a theoretical expression or by an experimental expression.

Meanwhile, rolling reduction correcting amounts ΔS5 and ΔS6 for the #5 and #6 stands to realize a material thickness variation Δh5 on condition that the material thickness h4 on the exit side of the #4 stand and the material thickness 16 on the exit side of the #6 stand remain unchanged are calculated by $$\Delta S5=\frac{m5+q5}{m5}\Delta h5^L \tag{7}$$

$$\Delta S6=-\frac{q6}{m6}\Delta h5^L \tag{8}$$

where mi is a mill spring constant at each stand and qi is a plasticity coefficient of the material of the work.

Such rolling reduction position correcting operations are carried out after necessary timing adjustments which involve consideration of travelling of the work.

In the load distribution control of the prior art, calculations of material thickness changing amounts and rolling reduction position correcting amounts use ideal coefficient values obtainable from rolling phenomenon model expressions which can be found out in advance as described hereinabove. In fact, however, due to inaccuracy of such coefficient values even if rolling reduction position correction depending upon a single load distribution correction calculation is performed for a given stand, fluctuation will be caused in a material thickness value on the exit side thereof and hence a rolling load change by a thickness control may be produced or a rolling load amount after changing at each stand may not coincide with a set value therefor, resulting in the necessity of performing another load distribution control. As a result of requirement of a time, longer than necessary, for convergence of the rolling load amounts to an appropriate ratio, portions having no accurate material thickness and having unacceptable strip shape will remain in a product, resulting in a great economical loss.

This originates from the fact that there exist some errors in various constants used for calculations in a load distribution controlling device and also in characteristics of an actual material being rolled, and thus, there is a room for improvement of such a load distribution controlling device.

SUMMARY OF THE INVENTION

It is an object of the present invention to provide a process by which a load distribution ratio between a plurality of stands by which a work is rolled while it passes therethrough can be adjusted rapidly to a desired value.

According to the process of the invention, each time correction control of load distribution among a plurality of selected stands is performed, an error between a set value and an actually measured value of a load distribution ratio when such control is to begin and rolling reduction positions and rolling loads at the stands then are stored, and then actual result values of rolling reduction position correction amounts and actual result values of varying amounts of loading loads until adjustment is completed after the control was initiated are stored as coefficient values, and then when the same situations is the correction control is performed appear thereafer, correction control amounts will be determined using the coefficient values thus stored.

DETAILED DESCRIPTION OF THE PREFERRED EMBODIMENT

Now, a system wherein the present invention is applied to three most downstream side stands of a six stand rolling mill will be described with reference to FIG. 1.

Figure 1:
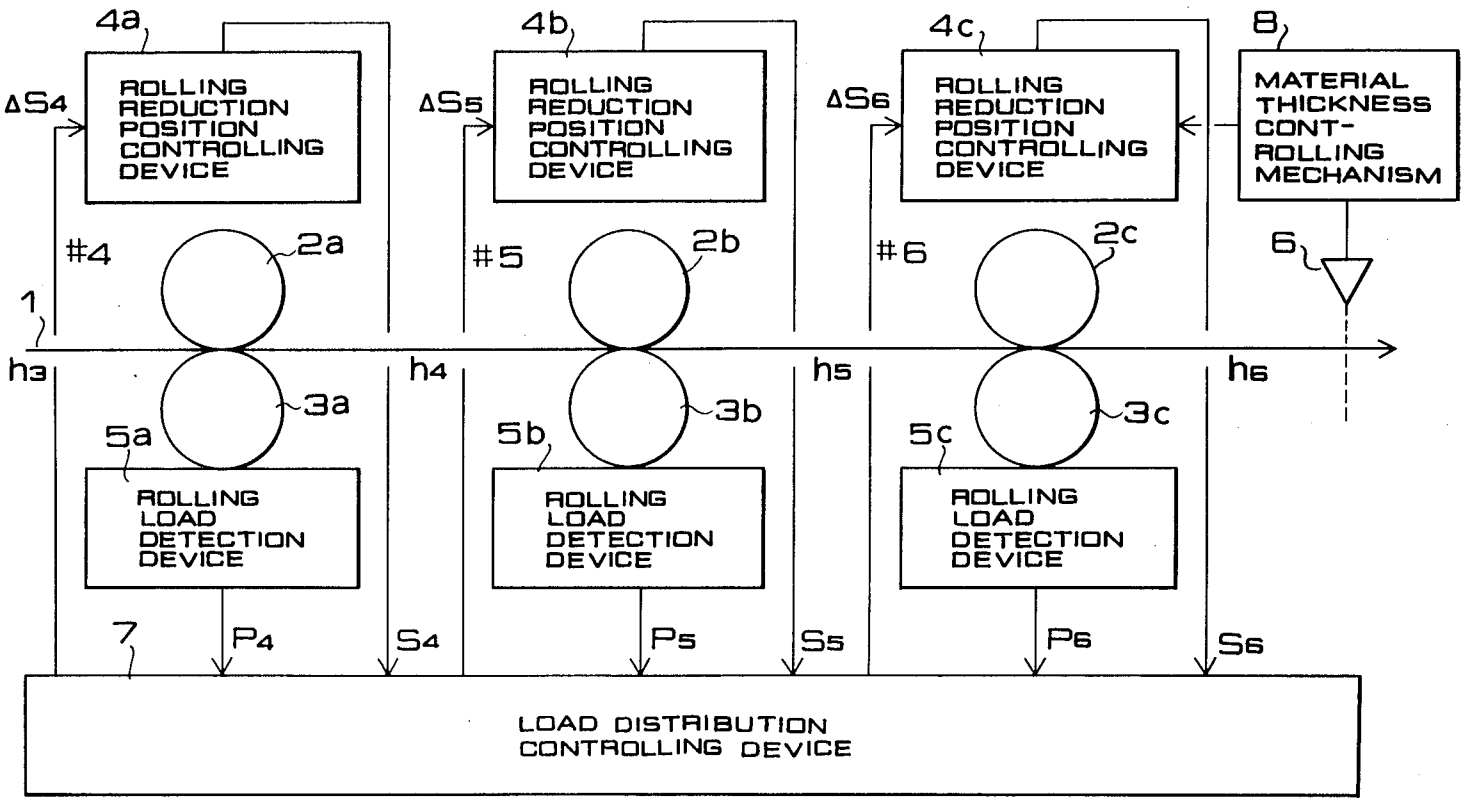
FIG. 1 illustrates a controlling format where a process embodying the present invention is applied to load distribution among three most downstream side stands of a continuous rolling mill which includes up to six stands.
Figure 2:
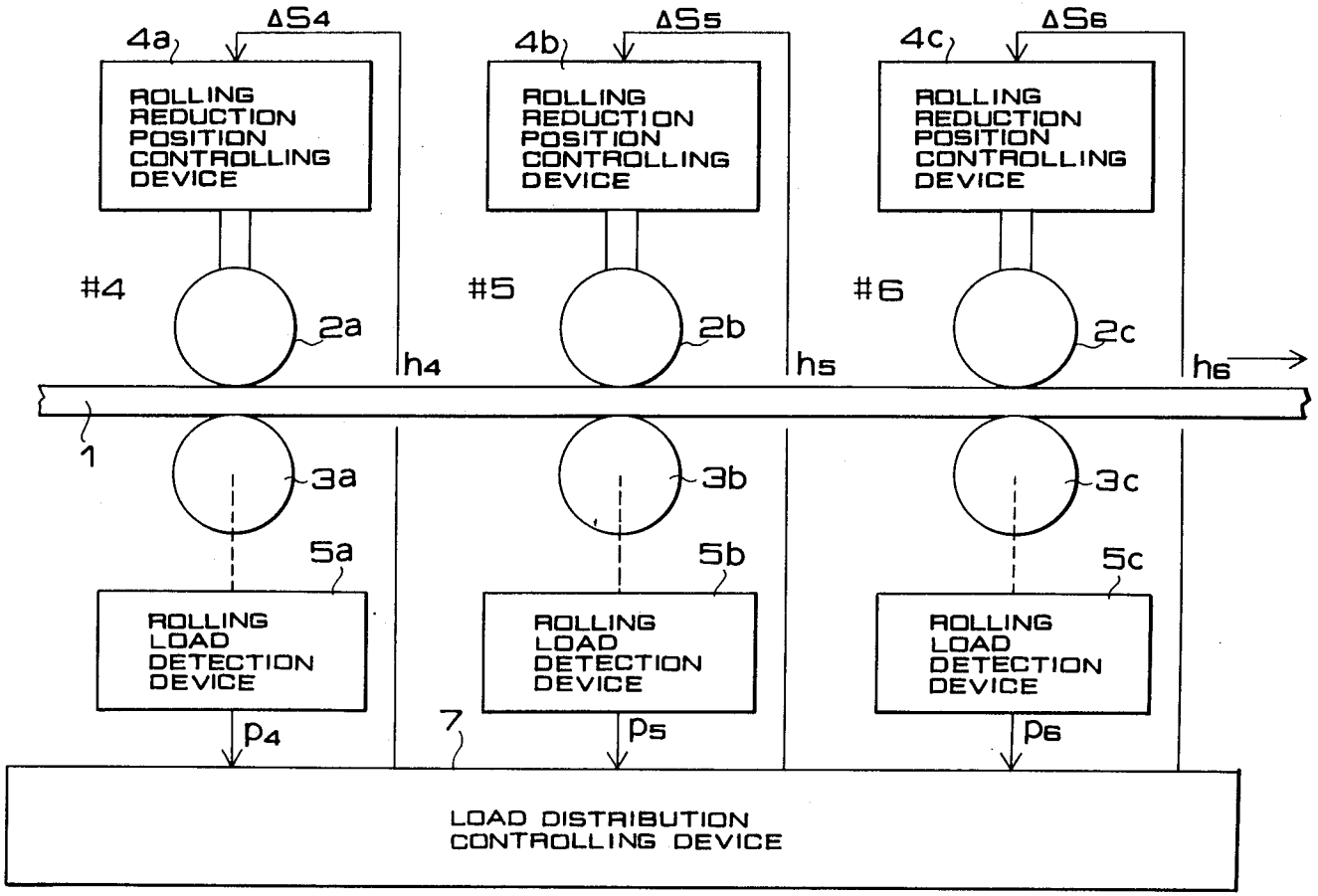
FIG. 2 (PRIOR ART)
FIG. 2 illustrates a similar format where a conventional process is employed.

FIG. 1 illustrates a plate material 1 being rolled at rolling stands #4, #5 and #6 represented by roll pairs 2a–3a, 2b–3b and 2c–3c. Each of the rolling stands #4, #5 and #6 includes a rolling reduction position controlling device 4a, 4b or 4c and a rolling load detecting device 5a, 5b or 5c. Detected values S4, S5 and S6 and P4, P5 and P6 from those devices are introduced to a rolling load distribution controlling device 7. It is to be noted that, in FIG. 1, reference numeral 6 designates an exit side material thickness detecting device, and 8 a material thickness controlling mechanism.

Here, when preset values for a load distribution ratio at the #4, #5 and #5 stands are C4, C5 and C6, respectively, then a load distribution error at the #5–#6 stands is $$\Delta err5 = C5 \cdot P6 - C6 \cdot P5 \tag{9}$$

and $$\Delta 5 = C5 \cdot Q6 + C6 \cdot Q5 \tag{10}$$

then $$\Delta h5^L = -\frac{\Delta err5}{\Delta 5} \tag{11}$$

is calculated to vary the rolling load amounts at the #5–#6 stands from P5, P6 to $P5^1$, $P6^1$, respectively. This has already been put into practice in the prior art. In this case, the load amounts $P5^1$, $P6^1$ after such variation become $$\begin{pmatrix} P5^1 \\ P6^1 \end{pmatrix} = \begin{pmatrix} P5 \\ P6 \end{pmatrix} + \begin{pmatrix} -Q5 \\ Q6 \end{pmatrix} \frac{\Delta err5}{\Delta 5} \tag{12}$$

$$= \left[ \begin{pmatrix} 1 & 0 \\ 0 & 1 \end{pmatrix} - \frac{1}{\Delta 5} \begin{pmatrix} Q5C6, & -Q5C5 \\ -Q6C6, & Q6C5 \end{pmatrix} \right] \begin{pmatrix} P5 \\ P6 \end{pmatrix}$$

$$= \frac{1}{\Delta} \begin{pmatrix} C5 \\ C6 \end{pmatrix} (Q6, Q5) \begin{pmatrix} p5 \\ P6 \end{pmatrix}$$

and from any load amounts P5, P6, they are corrected to $$P5^1 : P6^1 = C5 : C6 \tag{13}$$

In fact, by two or more sequences of the aforementioned calculating and controlling operations depending upon differences from actual values of constants Q5 and Q6 used in the aforementioned calculations as well as of the values q5, q6 and m5 and m6 used in the calculations of rolling reduction position correction amounts with the equations (7) and (8), a load distribution value is converged to a preset value therefor. According to the present invention, in controlling by a prior art process at a time when an error of a load distribution ratio at the #5–#6 stands is detected, such an error amount, the rolling reduction positions and the rolling load amounts at the stands are stored as $\Delta err5^0$, $S5^0$, $S6^0$, $P5^0$ and $P6^0$, and if the rolling reduction positions and rolling load amounts are $S5^1$, $S6^1$, $P5^1$ and $P6^1$ at a time when load distribution control is actually effected at this section, the following coefficient values for load distribution control are learned from differences between them.

$$\left.\begin{aligned} SS55 &= \frac{S5^1 - S5^0}{\Delta err^0} \\ SS56 &= \frac{S6^1 - S6^0}{\Delta err5^0} \end{aligned}\right\} \tag{14}$$

$$\left.\begin{aligned} PP55 &= \frac{P5^1 - P5^0}{\Delta err5^0} \\ PP56 &= \frac{P6^1 - P6^0}{\Delta err5^0} \end{aligned}\right\} \tag{15}$$

The coefficient values SS55 and SS56 are used later, when the same conditions appear the next time, for calculations of rolling reduction correcting amounts as follows:

$$\left.\begin{aligned} \Delta S5 &= SS55 \cdot \Delta err5 \\ \Delta S6 &= SS56 \cdot \Delta err5 \end{aligned}\right\} \tag{16}$$

From these values, it is apparent that determination of controlling amounts can be effected with more accuracy than by the rolling reduction position correcting calculations according to the equations (2) to (6) and (7) and (8).

Subsequently, a load distribution ratio between the #4 and #5 stands is determined, and if there is an error, $$\Delta err4^0 = C4 \cdot P5 - C5 \cdot P4 \tag{14}$$

is calculated. Then, the rolling reduction positions and rolling load amounts at this instant are stored as $S4^0$, $S5^0$, $S6^0$, $P4^0$, $P5^0$ and $P6^0$, and similarly to the equations (4) and (5)

$$\Delta 4 = C4 \cdot Q5 + C5 \cdot Q4 \tag{18}$$

$$\Delta h4^L = -\frac{\Delta err4}{\Delta 4} \tag{19}$$

-continued $$\left.\begin{aligned}\Delta S4^1 &= \frac{m4+q4}{m4}\,\Delta h4^L\\ \Delta S5^1 &= -\frac{q5}{m5}\,\Delta h4^L\end{aligned}\right\} \quad (20)$$

Further, a load distribution error amount which may newly appear at the #5–#6 as a result of this load distribution correction is forecasted as follows:

$$\Delta err5^1 = -C6\cdot\Delta P5^1 \quad (21)$$

Here, $\Delta P5^1$ is $$\Delta P5^1 = Q5\cdot\Delta h4^L \quad (22)$$

In connection with this forecasted load distribution error to the #5–#6, it is possible to calculate rolling reduction position correcting amounts and a load varying amount with high accuracy from the preceding actual results.

$$\left.\begin{aligned}\Delta S5^2 &= SS55\cdot\Delta\mathrm{err}5^1\\ \Delta S6^2 &= SS56\cdot\Delta\mathrm{err}5^1\end{aligned}\right\} \quad (23)$$

$$\Delta P5^2 = PP55\cdot\Delta err5^1 \quad (24)$$

A load distribution error amount $\Delta\mathrm{err}4^2$ between #4 and #5 according to this load variation (forecasted) can be forcasted as $$\Delta err4^2 = C4\cdot\Delta P5^2 \quad (25)$$

Rolling reduction position correcting amounts required for such correction are determined in a similar manner to that by the equations (19) and (20).

$$\Delta h4^2 = -\frac{\Delta\mathrm{err}4^2}{\Delta 4} \quad (26)$$

$$\left.\begin{aligned}\Delta S4^3 &= \frac{m4+q4}{m4}\,\Delta h4^2\\ \Delta S5^3 &= -\frac{q5}{m5}\,\Delta h4^2\end{aligned}\right\} \quad (27)$$

Then, $\Delta\mathrm{err}5^3$, $\Delta\mathrm{err}4^4$, . . . are further evaluated in a similar manner, and ΔS4, ΔS5 and ΔS5, ΔS6 for them are calculated one after another, thereby allowing required rolling reduction position correction values at the #4, #5 and #6 corresponding to the load distribution error $\Delta\mathrm{err}4^0$ and the #4–#5 stands to be found out as follows:

$$\left.\begin{aligned}\Delta S4 &= \Delta S4^1 + \Delta S4^3 + \Delta S4^5 + \ldots\\ \Delta S5 &= \Delta S5^1 + \Delta S5^2 + \Delta S5^3 + \Delta S5^4 + \ldots\\ \Delta S6 &= \Delta S6^2 + \Delta S6^4 + \Delta S6^6 + \ldots\end{aligned}\right\} \quad (28)$$

Actually, a very small repetitions of calculations will be sufficient since such repetitive calculations have an extremely fast exponential characteristic.

Rolling reduction position correcting instructions for the #4, #5 and #6 stands which are determined in this way are transmitted to the rolling reduction position controlling systems 4*a*, 4*b* and 4*c* of the respective stands under timing control appropriate for a travelling speed of the material.

At a time after the load distribution correction between #4 to #6 stands has been completed in this manner, rolling reduction positions and rolling load amounts are measured at the individual stands, and from values $S4^f$, $S5^f$, $S6^f$ and $P4^f$, $P5^f$ and $P6^f$ obtained from by measurements, following coefficient values are learned.

$$\left.\begin{aligned}SS44 &= \frac{S4^f - S4^0}{\Delta\mathrm{err}4^0}\\ SS45 &= \frac{S5^f - S5^0}{\Delta\mathrm{err}4^0}\\ SS46 &= \frac{S6^f - S6^0}{\Delta\mathrm{err}4^0}\end{aligned}\right\} \quad (29)$$

$$\left.\begin{aligned}PP44 &= \frac{P4^f - P4^0}{\Delta\mathrm{err}4^0}\\ PP45 &= \frac{P5^f - P5^0}{\Delta\mathrm{err}4^0}\\ PP46 &= \frac{P6^f - P6^0}{\Delta\mathrm{err}4^0}\end{aligned}\right\} \quad (30)$$

These learned values are used for calculations of rolling reduction position correction for the same conditions at the next time, allowing controlling with high accuracy and correction of an error in a very short period of time.

The process of the invention can also be utilized for calculations for rolling reduction position correction to load distribution errors on further upstream sides.

It is to be noted that, while rolling load amounts in the embodiment have been described as different from rolling reaction force amounts, where a distribution ratio of rolling reaction force amounts among stands is to be controlled, the very same effects can be provided if a constant value Qi is the same as a plasticity coefficient value qi and a rolling load detector is constituted as a rolling reaction force detector.

As apparent from the foregoing description, according to the present invention, while load distribution control is being performed, coefficient values necessary for calculations of correcting amounts are learned successively. Accordingly, also in case sufficiently accurate constant values cannot be found out or in case there is a change of the quality of a material during rolling, a load distribution ratio can always be brought into coincidence with a set value therefor within the shortest possible period of time. As a result, a large effect is had on reduction of a load to a mill operator as well as on improvement in accuracy of material thickness and reduction of unallowable wrong shaped portions of products.

What is claimed is:

1. A process for controlling load distribution in a continuous rolling mill having a plurality of rolling stands rolling a material, comprising the steps of:

detecting an initial rolling load and an initial rolling reduction position of each rolling stand, calculating a load distribution error when a ratio of detected loads of the most downstream rolling stand and the second most downstream rolling stand differ substantially from a predetermined ratio, computing rolling reduction correction values for the most and second most downstream rolling stands in response to the calculation of a load distribution error such that the thickness of the material on the exit side of the most downstream rolling stand remains unchanged and such that the ratio of rolling loads of the most and second most downstream rolling stands is equal to the predetermined ratio when the rolling stands are corrected in accordance with the rolling reduction correction values, said computing being performed using the calculated load distribution error together with (1) previously calculated correction coefficient values corresponding to similar mill operating conditions or (2) selected mill operating parameters when there is an absence of previously learned correction coefficient values corresponding to similar mill operating conditions, correcting the rolling reduction positions of the most and the second most downstream rolling stands in accordance with the computed rolling reduction correctional values, and calculating correction coefficient values from the load distribution error and the amount of correction of the most downstream rolling stands when said computing is performed using the selected mill operating parameters so that said computing can be subsequently performed using the calculated position correction coefficient values when the mill has similar operating conditions.

2. A process as claimed in claim 1 wherein there is included the further steps of determining a load distribution error between a third most downstream rolling stand and the corrected second most downstream rolling stand when a ratio of a rolling load of the third most downstream rolling stand to the corrected rolling load of the second most downstream rolling stand differs substantially from a second predetermined ratio, and computing a rolling reduction correction value for the third most downstream rolling stand and new rolling reduction correction values for the most and second most downstream rolling stands in response to the calculation of a load distribution error between the third and second most downstream rolling stands such that the thickness of the material on the exit side of the most downstream rolling stand remains unchanged and such that the ratios of rolling loads of the most, second most and third most downstream rolling stands are equal to the predetermined ratios, said second computing step being performed using the determined load distribution error between the third most downstream rolling stand and the corrected second most downstream rolling stand together with (1) previously calculated further correction coefficient values corresponding to similar mill operating conditions, or (2) selected mill operating parameters when there is an absence of previously learned further correction coefficient values corresponding to similar mill operating conditions, correcting the rolling reduction positions of the most, the second most and the third most rolling stands in accordance with the computed rolling reduction correction value for the third most downstream rolling stand and the new rolling reduction correction values for the most and second most downstream rolling stands, calculating further correction coefficient values from the load distribution error between the third most downstream rolling stand and the corrected second most downstream rolling stand and the amount of correction of the most, the second most and the third most downstream rolling stands when the second computing step is performed using the selected mill operating parameters.

3. A process as claimed in claim 1 wherein the step of calculating correction coefficient values is performed in accordance with the equations:

$$SS55 = \frac{S5^1 - S5^0}{\Delta err5^0}$$

$$SS56 = \frac{S6^1 - S6^0}{\Delta err5^0}$$

wherein

SS55 and SS56 are the calculated correction coefficient values for the respective second most and most downstream rolling stands, $\Delta err5^0$ is the load distribution error, $S5^0$ and $S6^0$ are the detected initial loads of the respective second most and most downstream rolling stands, and $S5^1$ and $S6^1$ are the corrected loads of the respective second most and most downstream rolling stands; and wherein the computing step includes computing rolling reduction correction values ΔS5 and ΔS6 of the respective second most and most downstream rolling stands in accordance with the equations:

$$\Delta S5 = SS55 \cdot \Delta err5$$

$$\Delta S6 = SS56 \cdot \Delta err5$$

when a load distribution error Δerr5 is subsequently calculated under similar mill operating conditions.

4. A process as claimed in claim 1 wherein said calculating of load distribution error, computing, and correcting steps are repeated prior to above mentioned step of calculating correction coefficient values until the ratio of detected loads equals the predetermined ratio.

* * * * *

UNITED STATES PATENT AND TRADEMARK OFFICE

CERTIFICATE OF CORRECTION

PATENT NO. : 4,617,814

DATED : October 21, 1986

INVENTOR(S) : Yoshikazu Kotera

It is certified that error appears in the above-identified patent and that said Letters Patent is hereby corrected as shown below:

Column 1, line 57, in equation (2), after "P" (second occurrence) insert the numeral --5--.

Column 2, line 5, in equation (6), after "Q" (second occurrence) insert the numeral --5--.

Column 2, line 16, delete the numeral "16" and insert therefor --h6--.

Signed and Sealed this

Twenty-eighth Day of April, 1987

*Attest:*

DONALD J. QUIGG

*Attesting Officer*

*Commissioner of Patents and Trademarks*